US006817064B2

(12) United States Patent
Kim et al.

(10) Patent No.: US 6,817,064 B2
(45) Date of Patent: Nov. 16, 2004

(54) HINGE DEVICE FOR STORAGE CONTAINER

(75) Inventors: Yong-Myoung Kim, Suwon (KR); Jeong-Man Nam, Kwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 41 days.

(21) Appl. No.: 10/157,844

(22) Filed: May 31, 2002

(65) Prior Publication Data

US 2003/0005548 A1 Jan. 9, 2003

(30) Foreign Application Priority Data

Jul. 5, 2001 (KR) ..... 2001-39946

(51) Int. Cl.[7] ..... E05D 11/10; E05D 11/08
(52) U.S. Cl. ..... 16/335; 16/336; 16/342
(58) Field of Search ..... 16/335, 336, 342, 16/340, 374; 220/830

(56) References Cited

U.S. PATENT DOCUMENTS 4,701,977 A * 10/1987 Hori et al. ..... 16/266
5,257,310 A * 10/1993 Takagi et al. ..... 379/433.13
5,500,982 A * 3/1996 Hosoi ..... 16/297
5,651,063 A * 7/1997 Ji et al. ..... 379/433.13
5,715,575 A * 2/1998 Kubota ..... 16/342
5,774,939 A * 7/1998 Lu ..... 16/342
5,918,348 A * 7/1999 Carpenter et al. ..... 16/342
6,035,491 A * 3/2000 Hartigan et al. ..... 16/342
6,119,310 A * 9/2000 Ohshima et al. ..... 16/342
6,209,173 B1 * 4/2001 Salter et al. ..... 16/342
6,453,804 B1 * 9/2002 Lee ..... 99/470

FOREIGN PATENT DOCUMENTS

JP 8-247134 * 9/1996
JP 11-230155 * 8/1999
JP 2001-288958 A * 10/2001

OTHER PUBLICATIONS

Korean Patent Abstracts (KR) of Publication No. 1020010017797; Publication Date 20010305.
Korean Patent Abstracts (KR) of Publication No. 1020010028642; Publication Date 20010406.

* cited by examiner

*Primary Examiner*—Chuck Y. Mah
(74) *Attorney, Agent, or Firm*—Staas & Halsey LLP

(57) ABSTRACT

A hinge device coupling a cover to a container body is minimized so as not to project from the container body to achieve a neat appearance, and is simplified to facilitate efficient production and installation. The hinge device includes a housing having a cavity and attached to one of the cover and the container body, a hinge shaft having a cam part rotatably housed in the housing and having a major axis and a minor axis in cross-section, an insert part extended from the cam part to protrude from the housing and connected to the other one of the cover and the container body, and a pair of leaf springs disposed in the housing to press respective outer surfaces of the cam part.

31 Claims, 7 Drawing Sheets

HINGE DEVICE FOR STORAGE CONTAINER

CROSS-REFERENCE TO RELATED APPLICATIONS

This application claims the benefit of Korean Patent Application No. 2001-39946 filed on Jul. 5, 2001, in the Korean Industrial Property Office, the disclosure of which is incorporated herein by reference.

BACKGROUND OF THE INVENTION

1. Field of the Invention

The present invention relates to a hinge device for a storage container, and, more particularly, to a hinge device for a storage container having a container body with a receptacle chamber and a top opening, and a cover closing the top opening of the receptacle chamber.

2. Description of the Related Art

In general, as a top opening-type storage container, a typical Kimchi storage container has a container body and a top cover attached to the container body to swingably open and close the container body. As shown in FIG. 1, the above-mentioned Kimchi storage container includes a container body 1, a receptacle chamber 2 formed therein, a top opening, a cover 3 closing the top opening of the receptacle chamber 2, and a hinge device 4 swingably coupling the cover 3 to the container body 1 and mounted on a rear upper portion of a side wall of the container body 1.

In the above top opening-type storage container, the hinge device 4 has a hinge case 4*a* attached to the rear upper portion of the side wall of the container body 1, and a hinge shaft 4*b* disposed in the hinge case 4*a* to swingably couple the cover 3 to the container body 1. Furthermore, the hinge case 4*a* is provided therein with an extendable rod 4*c* causing the cover 3 to be swung to an opened position or a closed position when the cover 3 is opened and closed, a coil spring 4*d* biasing the extendable rod 4*c*, and a guide groove 4*e* guiding the extending and swing motion of the extendable rod 4*c*. With the hinge device 4, the cover 3 is easily opened and closed because the cover 3 is biased to the opened position when being opened while the cover is also biased to the closed position when being closed.

However, the conventional hinge device for a storage container is complicated in configuration and somewhat bulky and is difficult to be mounted on the storage container during a production process thereof. In addition, the conventional hinge device has disadvantages in that the appearance is not neat and in that it is cumbersome in handling the storage container because the hinge device 4 is outwardly projected from the container body 1 to allow the extending and swing motion of the extendable rod 4*c*.

SUMMARY OF THE INVENTION

Accordingly, the present invention has been made to overcome the above and other problems occurring in the prior art, and an object of the present invention is to provide a hinge device for a storage container which is not projected from a container body due to size minimization, thereby providing a neat appearance to the container and also comfort of use to a user due to a reduction of a space occupied by the container.

It is another object of the present invention to provide a hinge device for a storage container, which is minimized in size and simplified to facilitate a production and attachment process of the hinge device and the storage container.

Additional objects and advantageous of the invention will be set forth in part in the description which follows and, in part, will be obvious from the description, or may be learded by practice of the invention.

In order to achieve the above and other objects, the present invention provides a hinge device rotatably coupling a cover to a container body in a storage container. The hinge device includes a housing having a cavity and attached to one of the cover and the container body, a hinge shaft having a cam part and an insert part extended from the cam part, the cam part rotatably disposed within the cavity of the housing and having a major axis and a minor axis in a cross-section, the insert part projected from the housing and connected to the other one of the cover and the container body, and a pair of leaf springs disposed in the housing to press corresponding opposite outer surfaces of the cam part.

The cam part may be provided with a pair of rounded corners and a pair of angular corners such that the pair of rounded corners are disposed at diagonally opposite corners and that the pair of angular corners are disposed at diagonally opposite the other corners. Each of the rounded corners is disposed between the angular corners, each of the angular corners is disposed between the rounded corners. Flat surfaces are provided between an adjacent rounded corner and angular corner.

The pair of leaf springs may be in contact with the corresponding opposite outer surfaces of the cam part while being maintained to be parallel to each other, and supported at opposite ends by support grooves formed at an inner surface of the housing.

Each of the flat surfaces of the cam part may be maintained to be inclined at a certain angle with respect to a tangential line of the leaf spring when the cover is completely opened or closed such that the leaf springs cause the hinge shaft to further rotate in an opening direction or in a closing direction.

An elastic buffer member may be disposed between the pair of leaf springs to absorb shock generated when the cover is opened and closed.

The cam part of the hinge shaft may be provided with a limit protrusion, and the housing may be provided at an inner surface with a limit step so that an opening motion of the cover is limited by engagement of the limit protrusion with the limit step.

The housing includes a housing body, a side wall formed at one side of the housing body and having a first hole through which the insert part of the hinge shaft passes, an open side formed at another side of the housing body opposite to the side wall and having an opening, and a housing cover adapted to close the opening of the open side of the housing body and having a second hole in which an end of the cam part of the hinge shaft is rotatably inserted, the cam part being supported by the housing cover.

The cam part may be formed with one or more grooves containing lubricant reducing frictional force between the leaf springs and the cam part.

BRIEF DESCRIPTION OF THE DRAWINGS

These and other objects and other advantages of the present invention will become apparent and more readily appreciated from the following detailed description of the embodiments, taken in conjunction with the accompanying drawings of which.

DETAILED DESCRIPTION OF THE PREFERRED EMBODIMENTS

Figure 1:
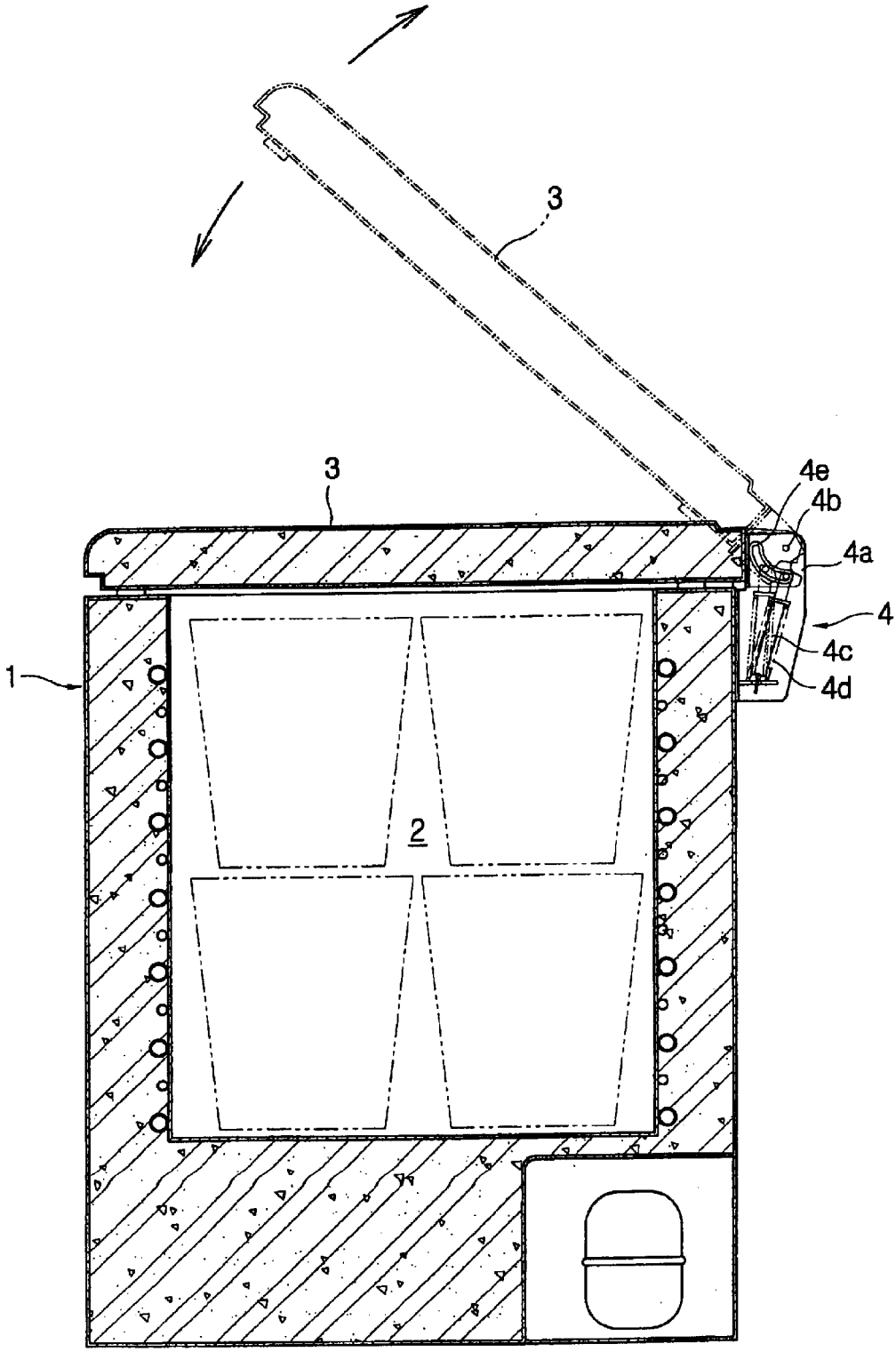
FIG. 1 (PRIOR ART)
FIG. 1 is a cross-sectional view of a conventional Kimchi storage container as a storage container having a cover and a container body.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

This invention will be described in further detail by way of example with reference to the accompanying drawings. In the following description, the present invention will be described as being applied to a top opening-type Kimchi storage container in which kimchi ferments and is preserved.

Figure 2:
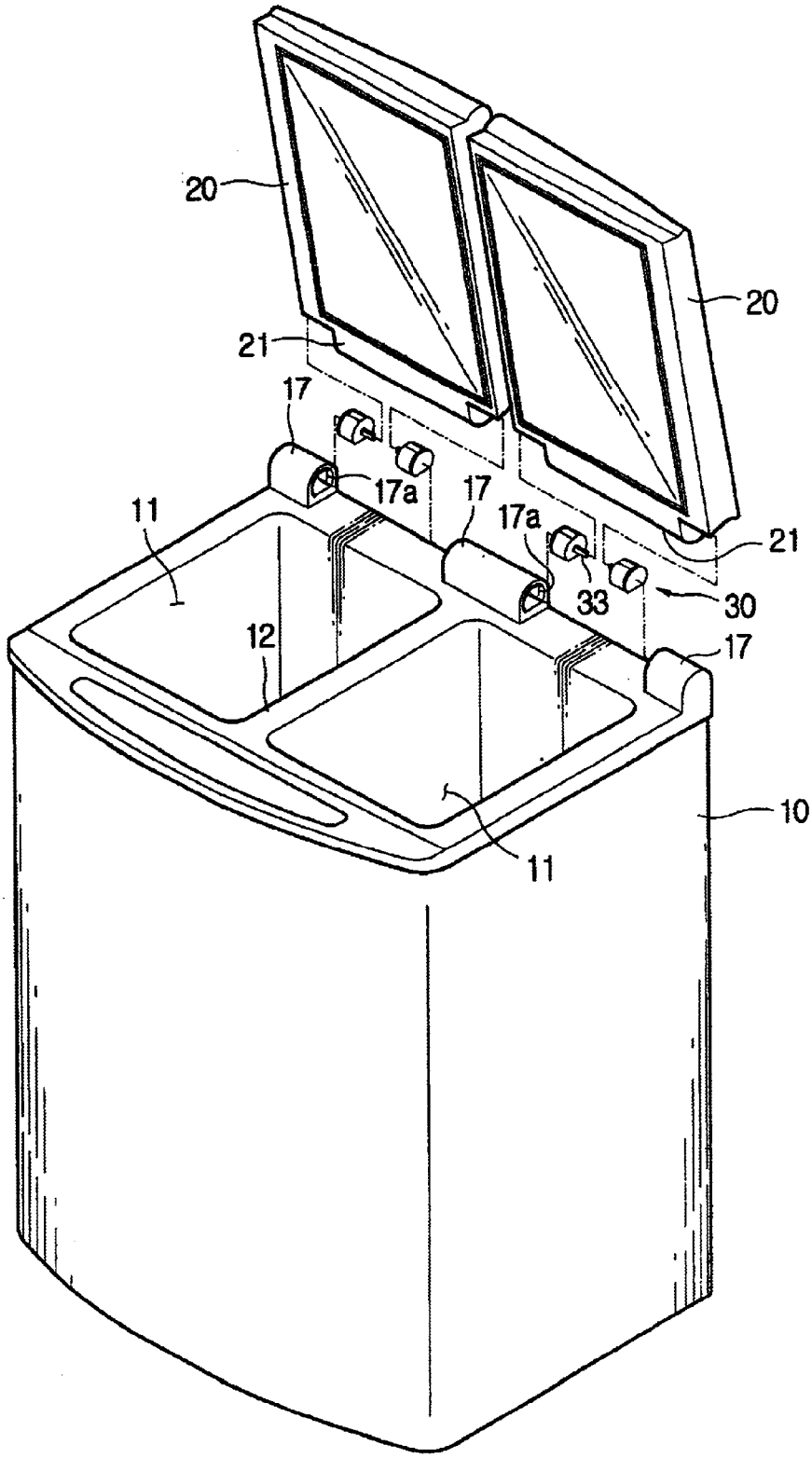
FIG. 2 is an exploded perspective view showing a Kimchi storage container having a hinge device according to an embodiment of the present invention.
Figure 3:
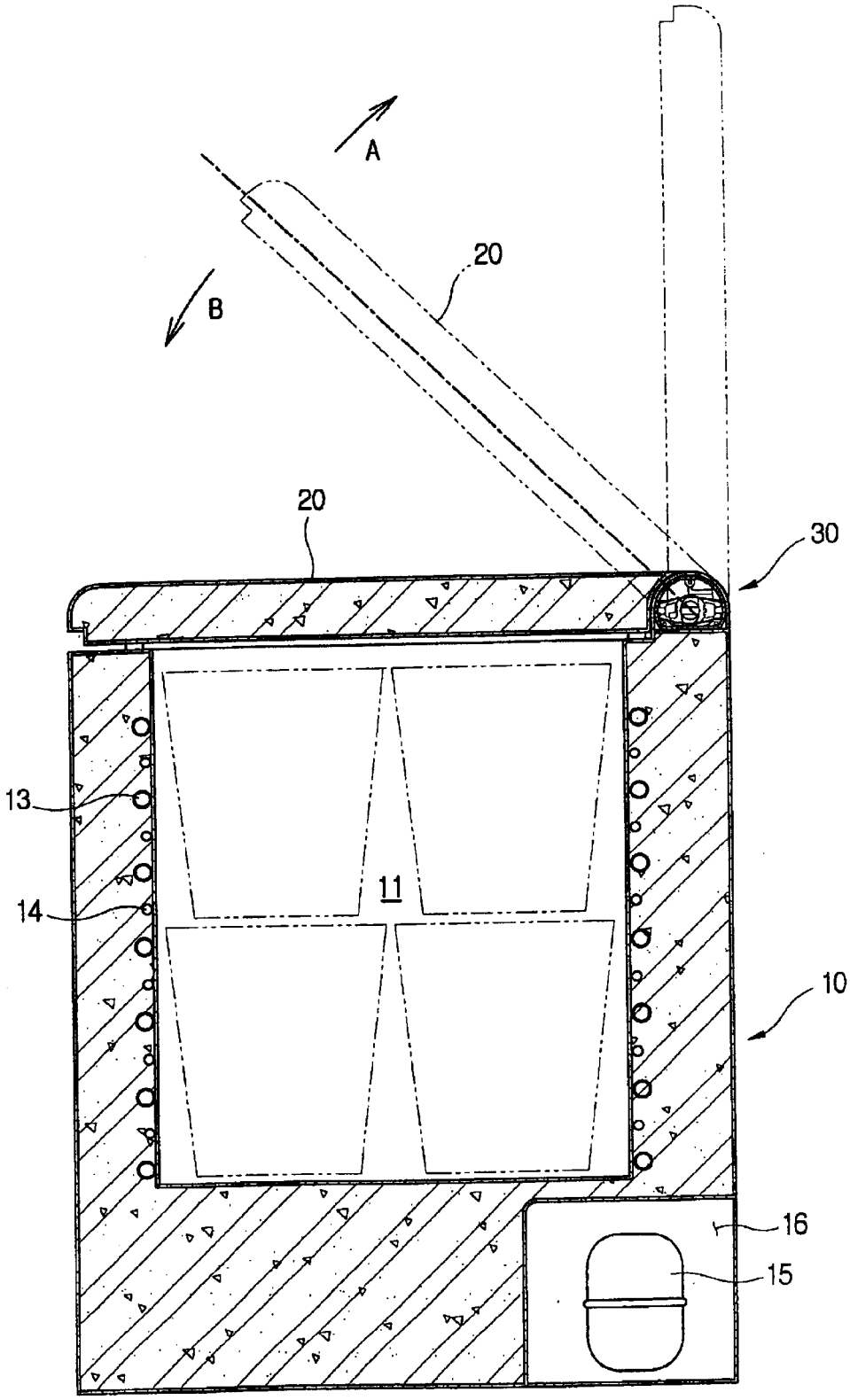
FIG. 3 is a cross-sectional view showing opening and closing operations of a cover and the hinge device of FIG. 2.

As shown in FIGS. 2 and 3, a Kimchi storage container according to an embodiment of the present invention includes a container body 10 made of a heat insulating material and having at least one receptacle chamber 11 with a top opening, and at least one cover 20 coupled to an upper end of the container body 10 to cover the top opening of the receptacle chamber 11 of the container body 10. The receptacle chamber 11 of the container body 10 is divided into left and right compartments by a partition plate 12. An evaporator 13 is provided in the walls of the container body 10 and includes a refrigeration pipe cooling the receptacle chamber 11 and a heater 14 heating the receptacle chamber 11 to ferment Kimchi. Furthermore, the container body 10 is provided at a lower machine room with a compressor 15 coupled to the evaporator 13. The compressor 15 and the heater 14 are coupled to an external power source.

Two covers 20 are provided to open and close the respective compartments of the receptacle chamber 11. Each cover 20 is swingably coupled to a rear portion to the container body 10 via at least one hinge device 30.

The hinge devices 30 function to swingably couple the covers 20 to the container body 10. Also, the hinge devices 30 cause the covers 20 to be swung to an opened position in a direction of an arrow "A" when a user opens the covers 20. The hinge devices 30 also cause the covers 20 to be swung to a closed position in a direction of an arrow "B" when the user closes the covers 20. As a result, the covers 20 are easily opened and closed although the covers 20 have a considerable weight due to the heat insulating material contained in the covers 20. In addition to the above-mentioned functions, the hinge devices 30 are relatively small in size so as not to be projected from the container body 10, thereby providing a neat appearance to the storage container.

To assemble each hinge device 30 into the storage container, the container body 10 is provided at an upper rear end with a plurality of hinge supports 17 which upwardly protrude and have a semicircular cross-section, and each cover 20 is provided at a rear end with a connector 21 adapted to be snugly fitted between two adjacent hinge supports 17, as shown in FIG. 2. Each end of the hinge supports 17 includes a fitting hole 17*a* to receive and fit the corresponding hinge device 30 therein. A hinge shaft 33 protrudes from the hinge device 30 and is rotatably inserted into a connecting hole 23 of the connector 21 of the cover 20. Although this embodiment of the present invention describes the hinge supports 17 formed on the container body 10 and the connector 21 formed on the cover 20, the hinge supports 17 may be provided at the cover 20, and the connector 21 may be provided at the container body 10.

Figure 4:
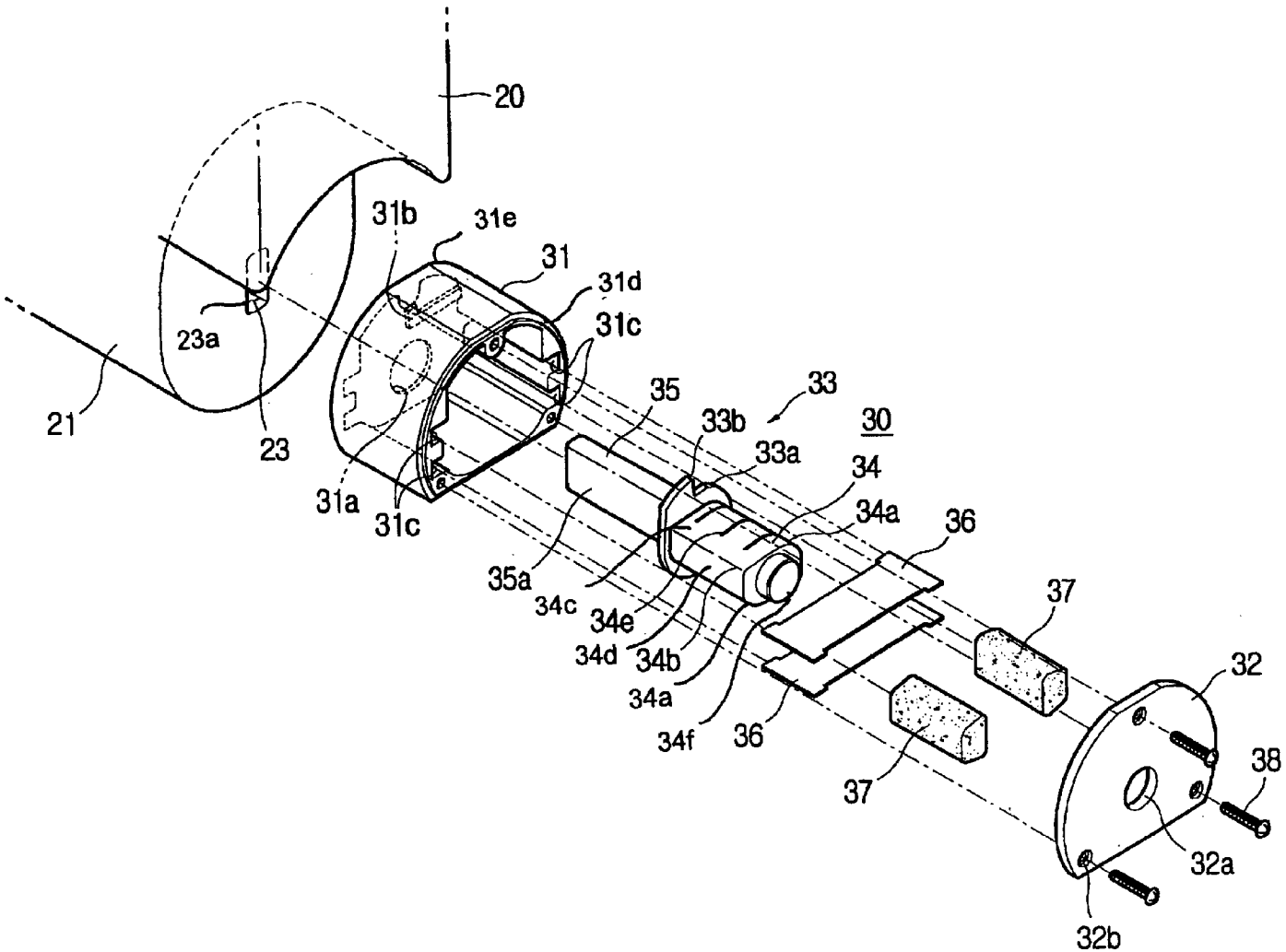
FIG. 4 is an exploded perspective view of the hinge device of FIG. 3.

As shown in FIG. 4, each hinge device 30 includes a housing body 31 having the same semicircular shape as the fitting hole 17*a* of the hinge support 17 in a cross-section such that the housing body 31 does not rotate within the fitting hole 17*a* of the hinge support 17. The hinge device 30 includes an open side 31*d* formed at a side of the housing 31, a side wall 31*e* formed at another side of the housing body 31 opposite to the open side 31*d*, a housing cover 32 attached to the open side of the housing body 31, a pair of leaf springs 36 elastically pressing the cam part 34 of the hinge shaft 33, and a pair of buffer members 37 disposed around the cam part 34 and between the leaf springs 36 to absorb shock generated when the cover 20 is opened and closed.

The cam part 34 is rotatably supported by the housing body 31 and the house cover 32, and the insert part 35 is extended from the cam part 34 and protrudes from the side wall 31*e* of the housing body 31 through a first through hole 31*a* formed on the side wall and then inserted into a connecting hole 23 of the connector 21. The first through hole 31*a* has a diameter equal to that of the insert part 35 such that the insert part 35 of the hinge shaft 33 is rotatably supported therein and passes therethrough. The insert part 35 is provided with first flat portions 35*a* corresponding to second flat portions 23*a* of the connecting hole 23 so that the insert part 35 is fixedly coupled to the connector 21.

The housing cover 32 is provided with a second through hole 32*a* such that a circular end 34*f* of the cam part 34 of the hinge shaft 33 is rotatably supported therein. The housing cover 32 is provided at a peripheral region with a plurality of screw holes 32*b* so that the housing cover 32 is attached to the open side 31*d* of the housing body 31 using fastening screws 38. With this configuration of the hinge device 30, when the housing cover 32 is attached to the housing body 31, the hinge shaft 33 can be rotatably supported by the side wall 31*e* of the housing body 31 and the housing cover 32 when the insert part 35 and the circular end 34*f* of the cam part are inserted into the first through hole 31*a* of the housing body 31 and the second through hole 32*a* of the housing cover 32, respectively.

A flange 33*a* is formed between the insert part 35 and the cam part 34, and a limit protrusion 33*b* is formed on the flange 33*a*. Round corners 34*a*, angular corners 34*b*, flat surfaces 34*c*, 34*d*, and at least one lubricant groove 3*e* is formed around the cam part 34. A limit step 31*b* is formed in the housing body 31 corresponding to the limit protrusion 33*b*. Supporting grooves 31*c* are formed in the housing body 31 to receive both ends of each leaf spring 36.

Figure 5:
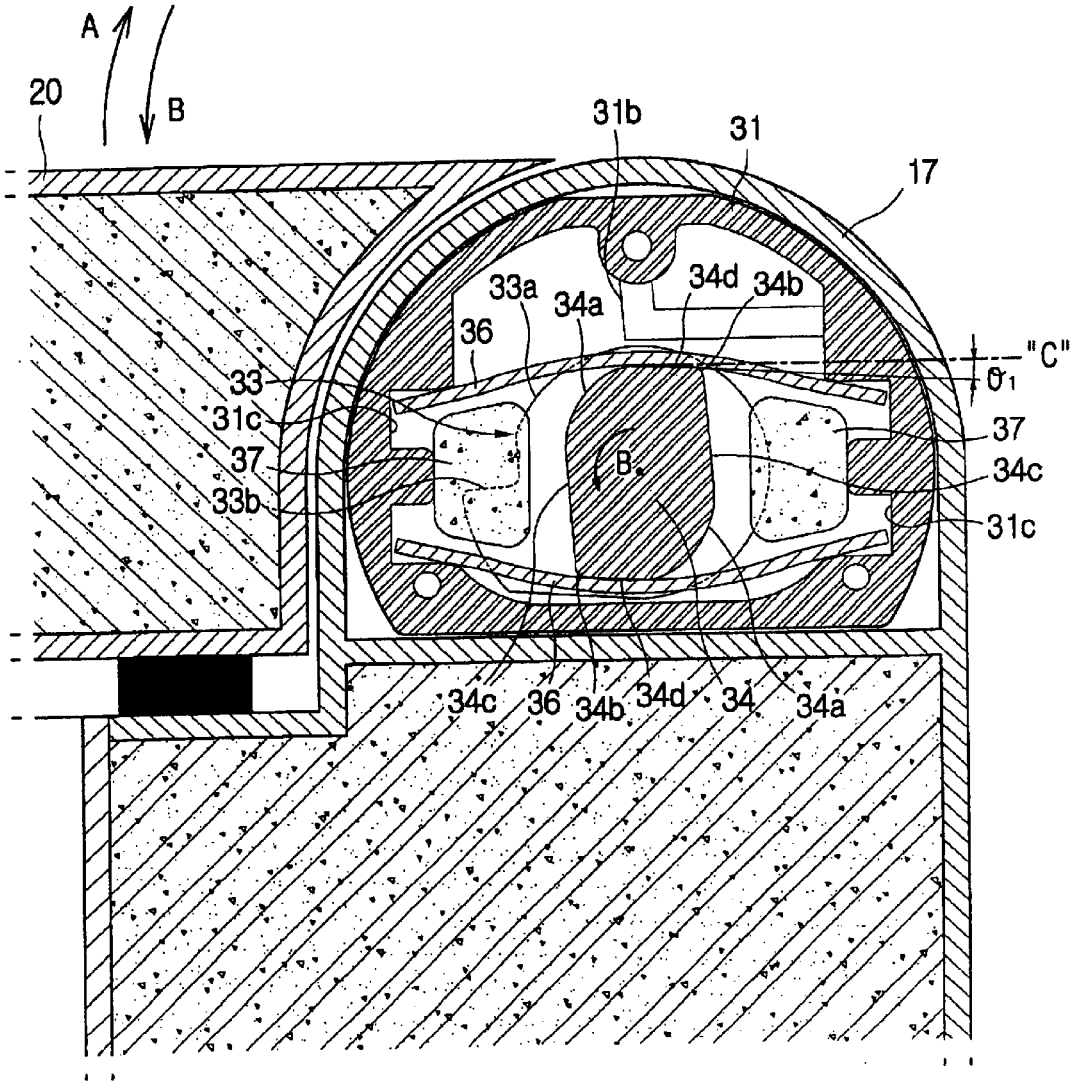
FIG. 5 is an enlarged cross-sectional view showing the hinge device of FIG. 3 when the corner is in a closed position.
Figure 6:
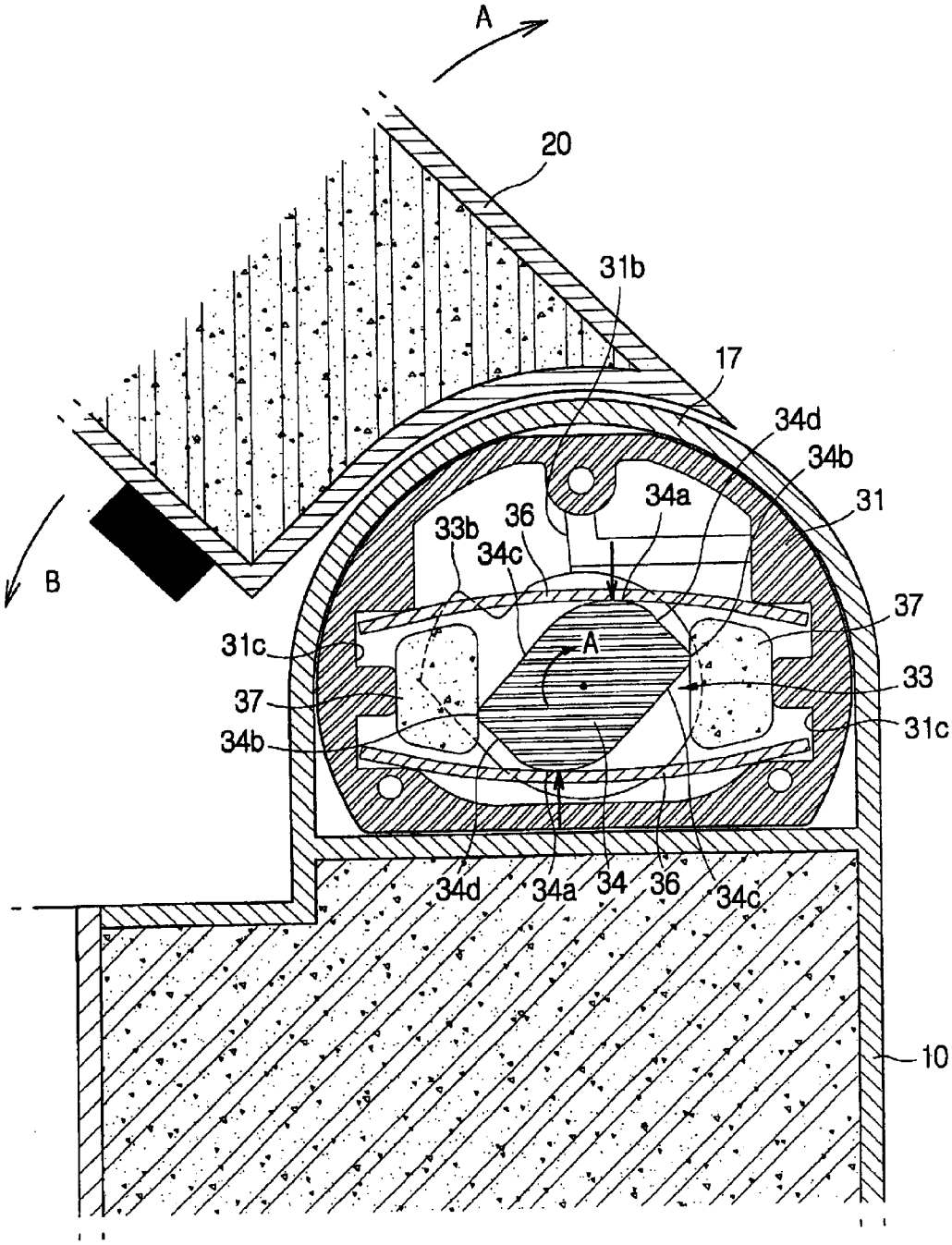
FIG. 6 is an enlarged cross-sectional view of the hinge device when the cover is between the closed position and an opened position.
Figure 7:
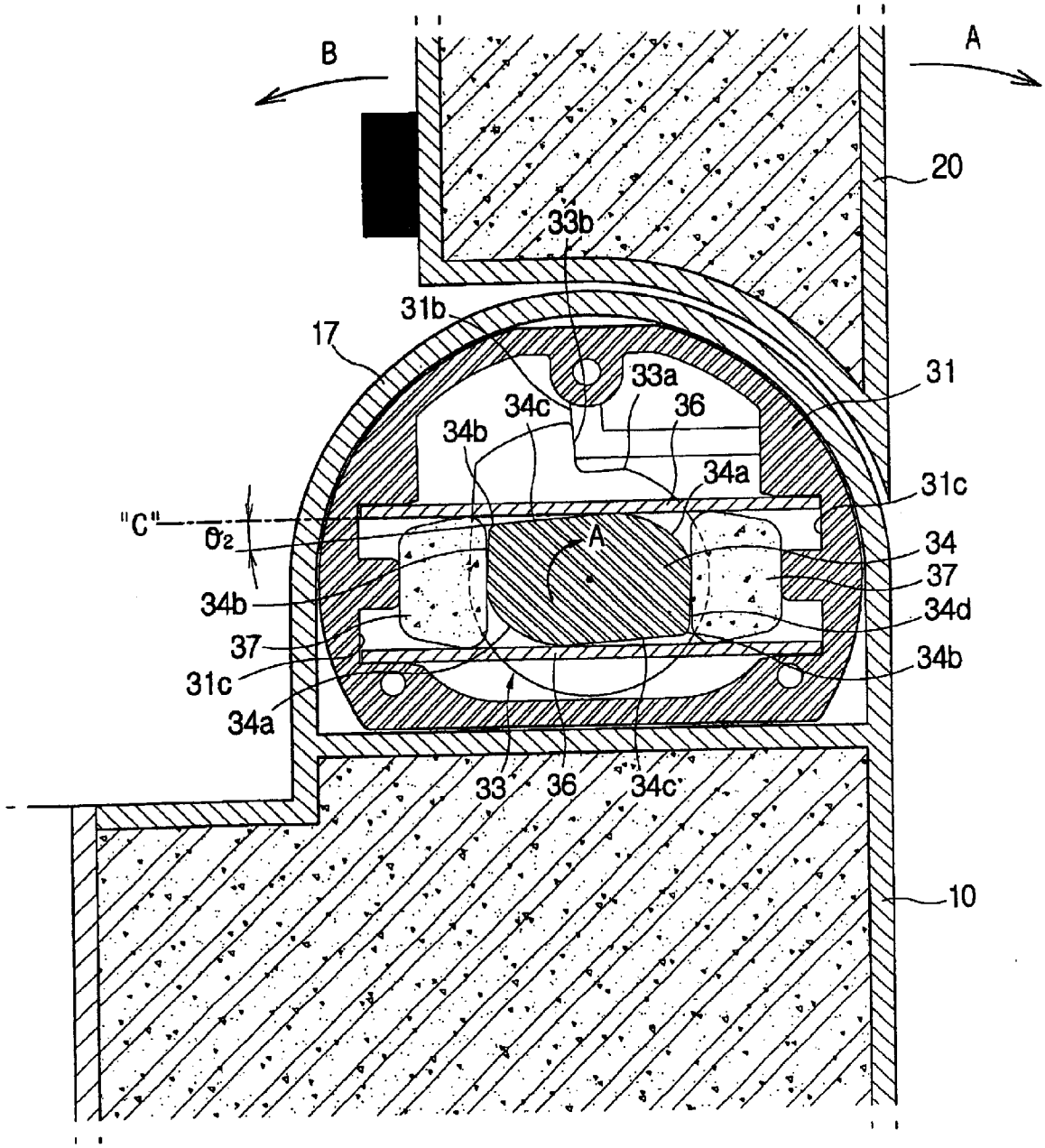
FIG. 7 is an enlarged cross-sectional view of the hinge device when the cover is in the opened position.

As shown in FIGS. 5 through 7, the cam part 34 is shaped to have an approximately rectangular cross-section having an axial axis, a major axis and a minor axis. The cam part 34 rotates about the axial axis, and the major and minor axes are perpendicular to the axial axis. Also, the cam part 34 is provided with a pair of the rounded corners 34*a* disposed at two corners diagonally symmetrical to each other around the cam part 34 and a pair of the angular corners 34*b* disposed at the other two corners around the cam part 34. The rounded corners 34*a* of the cam part 34 allow the cam part 34 to smoothly rotate between the leaf springs 36 when the leaf springs 36 are in close contact with the cam part 34.

Furthermore, the cam part 34 has the flat surfaces 34*c* and 34*d* between the adjacent rounded corner 34*a* and angular corner 34*b* such that the cam part 34 is prevented from being rotated when the leaf springs 36 come into contact with the flat faces 34*c*, 34*d*. The flat surfaces 34*c*, 34*d* includes large flat surfaces 34*c* corresponding to the major axis and small flat surfaces 34*d* corresponding to the minor axis. As shown in FIG. 4, the cam part 34 is formed with a plurality of the lubricant grooves 34*e* containing typical lubricant therein so that the cam part 34 smoothly rotates by virtue of a reduction of frictional force between the leaf springs 36 and the cam part 34. The lubricant grooves 34*e* are formed on a circumferential surface of the rounded corner 34*a* in a rotational direction of the cam part 34 for the sake of smooth rotation of the cam part 34.

The insert part 35 of the hinge shaft 33 is integrally formed with the cam part 34 by injection molding. The insert part 35 is formed at opposite sides with a pair of the first flat portions 35*a* corresponding to the second flat portion 23*a* of the connecting hole 23, and the connecting hole 23 of the connector 21 of the cover 20 has a shape corresponding to a cross section of the insert part 35. With the insert part 35 and the connecting hole 23, the hinge shaft 33 can rotate together with the cover 20 when the cover 20 is opened and closed.

The hinge shaft 33 is provided at a boundary between the insert part 35 and the cam part 34 with the flange 33*a* larger than the cam part 34 in diameter so that the hinge shaft 33 can be stably and smoothly supported within the housing body 31. The flange 33*a* has the limit protrusion 33*b* to limit the opening of the cover 20 to a predetermined position. The housing body 31 is provided at an inner surface with the limit step 31*b* so that the cover 20 is stopped at the position where the limit protrusion 33*b* of the flange 33*a* comes into contact with the limit step 31*b* of the housing body 31.

The pair of leaf springs 36 are each made of a steel plate and elastically press opposite outer surfaces of the cam part 34, such as the rounded corner 34*a* or the flat surfaces 34*c*, 34*d* . The pair of leaf springs 36 are disposed to be parallel to each other such that the cam part 34 is prevented from being unbalanced by the pressing force of the leaf springs 36 during rotation of the cam part 34. The leaf springs 36 are supported at the opposite ends in the supporting grooves 31*c* formed at opposite inner surfaces of the housing body 31. As mentioned above, the cam part 34 is shaped into the rectangular form having the major axis and the minor axis in cross-section and provided with the rounded corners 34*a* and the flat faces 34*c* and 34*d*. Since the outer surfaces of the cam part 34 are subjected to the pressing force of the leaf springs 36, the hinge device 30 causes the cover 20 to be more easily opened in the direction of the arrow "A" when the user opens the cover 20, and the hinge device 30 also causes the cover 20 to be more easily closed in the direction of the arrow "B" when the user closes the cover 20, thereby achieving easy opening and closing operations of the cover 20.

As shown in FIGS. 5 through 7, the flat surfaces 34*c* and 34*d* of the cam part 34 are adapted to be positioned to have an angle "$\theta_1$" or "$\theta_2$" with respect to tangential lines "C" from points where the leaf springs 36 are in contact with the cam part 34 when the cover 20 is completely closed or opened. Since the cover 20 rotates in the closing direction or the opening direction until the cover 20 is completely opened or closed, the cover 20 is prevented from being shaken. A more detailed description of the hinge device 30 for preventing shaking of the cover 20 will be described in a later part of this description.

As mentioned above, since the leaf springs 36 of the hinge device 30 are adapted to press the outer surfaces of the cam part 34, even if the hinge shaft 33 receives high torque due to the considerable heavy weight of the cover 20 made of the heat insulating material, the cover 20 can be easily opened and closed. To provide stable support of the opposite ends of the leaf springs 36, the housing body is relatively thick at a wall formed with the supporting grooves 31*c* to increase rigidity.

The buffer members 37 are made of an elastic material, such as urethane, a rubber material, and a sponge, and disposed between the leaf springs 36 and on both sides of the cam part 34. The buffer members 37 reduce shock and vibration exerted on the hinge shaft 33 and the leaf springs 36 during rotation of the hinge shaft 33 in response to opening and closing operations of the cover 20, thereby providing smooth opening and closing operations of the cover 20. The buffer members 37 are shaped to have a length equal to that of the cam part 37. The buffer members 37 are in contact with both leaf springs 36 and both sides of the cam part 34 when the cover 20 is completely opened.

The opening and closing operations of the hinge device 30 according to the embodiment of the present invention will now be described in detail hereinafter.

When the cover 20 is closed as shown in FIG. 5, the major axis of the cam part 34 of the hinge shaft 33 is upright, and the cam part 34 is pressed at the small flat surfaces 34*d* by the leaf springs 36. At this point, since the small flat surfaces 34*d* of the cam part 34 being in contact with the leaf springs 36 are positioned to have an angle "$\theta_1$" with the respective tangential lines "C" of the leaf springs 36, the hinge shaft 33 tends to further rotate in the direction of the arrow "B", i.e., in the closing direction.

When the hinge shaft 33 is opened by a certain degree by the user as shown in FIG. 6, the cam part 34 is pressed at the rounded corners 34*a* by the leaf springs 36. At this point, since the points where the leaf springs 36 are in contact with the cam part 34 are deviated from a plane containing the major axis of the hinge shaft 33, the hinge shaft 33 is caused to rotate in the opening direction of the arrow "A". Accordingly, the cover 20 is automatically opened by the rotation of the hinge shaft 33 due to the leaf springs 36, even though the user does not have to completely lift the cover 20 to an open position.

When the cover 20 is completely opened as shown in FIG. 7, the cam part 34 of the hinge shaft 33 rotates so that the major axis is parallel to the leaf springs 36 and so that the leaf springs 36 come into contact with a portion of the large flat surfaces 34*c* of the cam part 34. At this point, since the limit protrusion 33*b* of the hinge shaft 33 is engaged with the limit step 31*b* of the housing body 31, the cover 20 is prevented from rotating more than the open position.

Since the large flat surfaces 34*c* of the cam part 33 being in contact at the portion with the leaf springs 36 are maintained to be inclined at a certain angle of "$\theta_1$" from the tangential lines "C" of the leaf springs 36 when the cover 20 is completely opened, the hinge shaft 33 has a tendency to further rotate in the opening direction of the arrow "A". Therefore, the hinge shaft 33 tends to further rotate in the opening direction until the limit protrusion 33*b* is engaged with the limit step 31*b* of the housing body 31. As a result, the cover 20 is prevented from being shaken when the cover 20 is completely opened at the open position. In addition, since shock and vibration transmitted to the cam part 34 of the hinge shaft 33 and the leaf springs 36 and generated when the cover 20 is opened are reduced by the buffer members 37, a silent and smooth opening operation of the cover 20 can be achieved.

As described above, the present invention provides a hinge device for a storage container which enables a cover to be coupled to a container body, and which is minimized in size so as not to project from the container body, thereby achieving a neat appearance at the container and reduction of space occupied by the container.

Furthermore, since the hinge device is minimized in size and simplified in construction as compared with a conventional hinge device, production and installation of the hinge device can be easily performed.

Additionally, since a hinge shaft is caused to be rotated by a compressing action of a cam part of the hinge shaft by leaf springs, thereby serving to open and close a cover, easy opening and closing of the cover can be achieved.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A hinge device rotatably coupling a cover to a container body in a storage container, comprising:

a housing having a cavity and attached to one of the cover and the container body;

a hinge shaft having a cam part and an insert part extended from the cam part, the cam part rotatably disposed within the cavity of the housing, the insert part projected from the housing and connected to the other one of the cover and the container body;

a pair of leaf springs disposed in the housing to press respective opposite outer surfaces of the cam part; and an elastic buffer member disposed between the pair of leaf springs to absorb shock generated when the cover is opened or closed.

2. The hinge device of claim 1, wherein the housing comprises support grooves to support each end of the pair of leaf springs to allow the pair of leaf springs to be in contact with the respective opposite outer surfaces of the cam part while being maintained to be parallel to each other.

3. The hinge device of claim 1, wherein the cam part comprises flat surfaces, a pair of rounded corners and a pair of angular corners, the pair of rounded corners are disposed at diagonally opposite corners, the pair of angular corners are disposed at diagonally opposite other corners, and the flat surfaces are provided between an adjacent rounded corner and angular corner.

4. The hinge device of claim 3, wherein a first pair of opposite flat surfaces of the cam part are maintained to be inclined at a predetermined angle with respect to a tangential line of corresponding ones of the leaf springs when the cover is completely opened and a second pair of opposite flat surfaces of the cam part are maintained to be inclined at another predetermined angle with respect to a tangential line of the corresponding ones of the leaf springs when the cover is completely closed such that the hinge shaft is biased to further rotate in one of an opening direction and a closing direction.

5. The hinge device of claim 1, wherein the cam part of the hinge shaft comprises a limit protrusion, and the housing comprises at an inner surface a limit step so that an opening motion of the cover is limited by engagement of the limit protrusion with the limit step when the cover is opened or closed.

6. The hinge device of claim 1, wherein the housing comprises a housing body, a side wall formed at one side of the housing body and having a first hole, an open side formed at another side of the housing body and having an opening, and a housing cover covering the opening of the open side and having a second hole, and the insert part of the hinge shaft passes through the first hole of the side wall while an end of the cam part of the hinge shaft is rotatably inserted into the second hole of the housing cover.

7. The hinge device of claim 1, wherein the cam part comprises at least one groove containing lubricant reducing frictional force between the leaf springs and the cam part.

8. A hinge device in a storage container, comprising:

a housing having a housing body, a first side wall formed on one side of the housing body and having a first hole, and a second side wall formed on another side of the housing body opposite to the first side and having a second hole;

a hinge shaft disposed in the housing body, having a cam part and an insert part extended from the cam part, the insert part having a first end protruding from the housing through the first hole of the first side wall, the cam part having a second end inserted into the second hole of the second side wall;

at least one leaf spring coupled to the housing body, being in contact with an outer surface of the cam part to press the cam part; and at least one buffer member disposed around the cam part to contact the leaf spring to absorb shock generated when the cam part rotates.

9. The hinge device of claim 8, wherein the cam part comprises an angular corner, a small flat surface, a round corner, and a large flat surface, and the outer surface of the cam part contacting the leaf spring is one of the angular corner, the small flat surface, the round corner, and the large flat surface.

10. The hinge device of claim 9, wherein the leaf spring is in contact with the small flat surface, the angular corner, the large flat surface in order when the hinge shaft rotates in a first direction and in reverse order when the hinge shaft rotates in a second direction opposite to the first direction.

11. The hinge device of claim 9, wherein the buffer member does not contact the leaf spring when the cam part is in contact with the small flat surface.

12. The hinge device of claim 9, wherein the buffer member is in contact with the leaf spring when the cam part is in contact with the large flat surface.

13. The hinge device of claim 9, wherein the buffer member has the same length as the cam part.

14. The hinge device of claim 8, wherein the at least one leaf spring comprises first and second leaf springs coupled to the housing body, and the first and second leaf springs are disposed at opposite first sides of the cam part to contact opposite outer surfaces of the cam part.

15. The hinge device of claim 14, wherein the at least one buffer member comprises first and second buffer members, the first and second buffer members being disposed around opposite second sides of the cam part other than the first sides and between the first and second leaf springs to contact the first and second leaf springs in response to rotation of the cam part.

16. The hinge device of claim 15, wherein the cam part comprises a pair of angular corners, a pair of small flat surfaces, a pair of round corners, and a pair of large flat surfaces, and the opposite outer surfaces of the cam part contacting the leaf spring and the additional leaf spring, respectively, are one pair of the pair of angular corners, the pair of small flat surfaces, the pair of round corners, and the pair of large flat surfaces.

17. The hinge device of claim 16, wherein the large flat surface is wider than the small flat surfaces.

18. The hinge device of claim 16, wherein the large flat surfaces have an angle with respect to corresponding leaf springs when the cam part rotates to cause the small flat surfaces to face the buffer member.

19. The hinge device of claim 16, wherein the small flat surfaces have an angle with respect to corresponding leaf springs when the cam part rotates to cause the large flat surfaces to face the buffer member.

20. The hinge device of claim 16, wherein the rounded corners are disposed at diagonally opposite corners of the cam part, and the angular corners are disposed at diagonally opposite other corners of the cam part.

21. The hinge device of claim 16, wherein each of the small and large flat surfaces is disposed between an adjacent rounded corner and angular corner.

22. The hinge device of claim 16, wherein each of the rounded corners is disposed between an adjacent large flat surface and small flat surface.

23. The hinge device of claim 8, wherein the hinge shaft comprises a flange formed between the cam part and the insert part and a limit protrusion formed on the flange, and the housing body comprises a limit step contacting the limit protrusion to limit rotation of the hinge shaft when the hinge shaft rotates with respect to the housing body to a predetermined position.

24. The hinge device of claim 23, wherein the flange, the cam part, and the insert part are integrated in a monolithic body.

25. The hinge device of claim 8, wherein the cam part comprises a groove containing lubricant, and the grove is formed on the outer surface of the cam part so that the cam part rotates smoothly while contacting the leaf spring.

26. The hinge device of claim 8, wherein the cam part comprises a circular end opposite to the insert part, and the circular end has the same shape as the second hole to be inserted into the second hole while the cam part is rotatably disposed within the housing body.

27. The hinge device of claim 8, wherein the hinge shaft rotates about an axial axis passing through the cam part and the insert part with respect to the housing body.

28. The hinge device of claim 27, wherein the cam part comprises a major axis and a minor axis disposed on a plane perpendicular to the axial axis of the cam part and further comprises a large surface corresponding to the major axis and a small surface corresponding to the minor axis, and the buffer member is not in contact with the leaf spring when the leaf spring contacts the small surface while the buffer member is in contact with the leaf spring when the leaf spring contacts the large surface.

29. The hinge device of claim 8, wherein the housing body comprises a pair of supporting grooves, wherein both ends of the leaf spring are inserted into corresponding supporting grooves while a central portion of the leaf spring contacts the cam part.

30. The hinge device of claim 8, wherein the first through hole has a first round portion and a first flat portion, and the insert part has a second round portion having the same radius of the first round portion and a second flat portion corresponding to the first flat portion of the first through hole.

31. The hinge device of claim 8, wherein the buffer members are made of one of urethane, a rubber material and a sponge.

* * * * *